US005128006A

United States Patent [19]

Mitchell et al.

[11] Patent Number: 5,128,006

[45] Date of Patent: Jul. 7, 1992

[54] DEPOSITION OF DIAMOND FILMS ON SEMICONDUTOR SUBSTRATES

[75] Inventors: James W. Mitchell, Somerset; Jorge L. Valdes, Bedminster, both of N.J.

[73] Assignee: AT&T Bell Laboratories, Murray Hill, N.J.

[21] Appl. No.: 644,789

[22] Filed: Jan. 23, 1991

[51] Int. Cl.[5] ..... C25D 13/02

[52] U.S. Cl. ..... 204/181.5; 204/180.2

[58] Field of Search ..... 204/181.5

[56] References Cited

U.S. PATENT DOCUMENTS 2,858,256 10/1958 Fahnoe et al. ..... 204/181.5
3,766,125 10/1973 Hansen et al. ..... 204/181.5
3,929,590 12/1975 Heyes ..... 204/181.5
4,490,229 12/1984 Mirtich et al. ..... 204/192.11
4,504,519 3/1985 Zelez ..... 427/39
4,767,517 8/1988 Hiraki et al. ..... 204/192.25
4,822,466 4/1989 Rabalais et al. ..... 204/192.15

*Primary Examiner*—John Niebling
*Assistant Examiner*—Kishor Mayekar
*Attorney, Agent, or Firm*—Peter V. D. Wilde

[57] ABSTRACT

Process for coating articles with thin film of diamond, and related diamond-like materials, using an electrophoretic technique. Diamond particles are suspended in a liquid electrolyte and subjected to a directional field which causes migration and deposition on a selected substrate electrode.

2 Claims, 1 Drawing Sheet

DEPOSITION OF DIAMOND FILMS ON SEMICONDUTOR SUBSTRATES

BACKGROUND OF THE INVENTION

This invention relates to processes for coating articles with diamond and related refractory material coatings.

DESCRIPTION OF THE PRIOR ART

Processes for making synthetic diamonds have been of interest for many years. Synthetic diamonds have important industrial applications as well as their more widely known appeal as gemstones. Recently, thin layers of synthetic diamond have found use for heat sinks in high frequency power switching devices, laser diodes, and highly integrated semiconductor devices.

Many of the successful diamond synthesis techniques form bulk diamond material. High pressure and high temperature processes form large diamond crystals that may then be cut in various forms, including thin plates, for industrial uses. Direct formation of diamond thin films can be achieved in a variety of known ways. Cathode sputtering in a hydrogen plasma is described in U.S. Pat. No. 4,767,517. Ion beam deposition of diamond from a hydrocarbon plasma is taught in U.S. Pat. Nos. 4,490,229 and 4,822,466. A film deposition approach using electrical discharge between carbon electrodes in an inert gas is described in U.S. Pat. No. 3,840,451. Coating of semiconductor substrates using RF plasma decomposition of alkanes is described in U.S. Pat. No. 4,504,519. All of these prior art thin film techniques use gas or vapor phase reactions.

In applying these techniques to coating semiconductor substrates, it is common to encounter problems associated with broad-area nucleation, selected-area patterning, and adhesion of the diamond layer to the substrate. Various proposals for overcoming adhesion problems have been proposed including the use of a predeposited nucleating layer. These nucleating layers are also typically formed by CVD-type techniques.

STATEMENT OF THE INVENTION

According to this invention, uniform and adherent deposition of diamond layers on various substrates, e.g. semiconductor substrates, is attained by predepositing a nucleating layer of diamond particles using an electrophoretic technique. Diamond particles suspended in a liquid electrolyte are subjected to a directional field and caused to migrate and deposit on a substrate in contact with a selected electrode. Layers of other refractory, crystalline materials, e.g. silicon carbide, boron nitride, can be formed by the techniques described. Using appropriate masking techniques these predeposited nucleating particle layers can be patterned.

DESCRIPTION OF THE DRAWING

The FIGURE depicts an apparatus useful for carrying out the process of the invention.

DETAILED DESCRIPTION OF THE INVENTION

Figure 1:
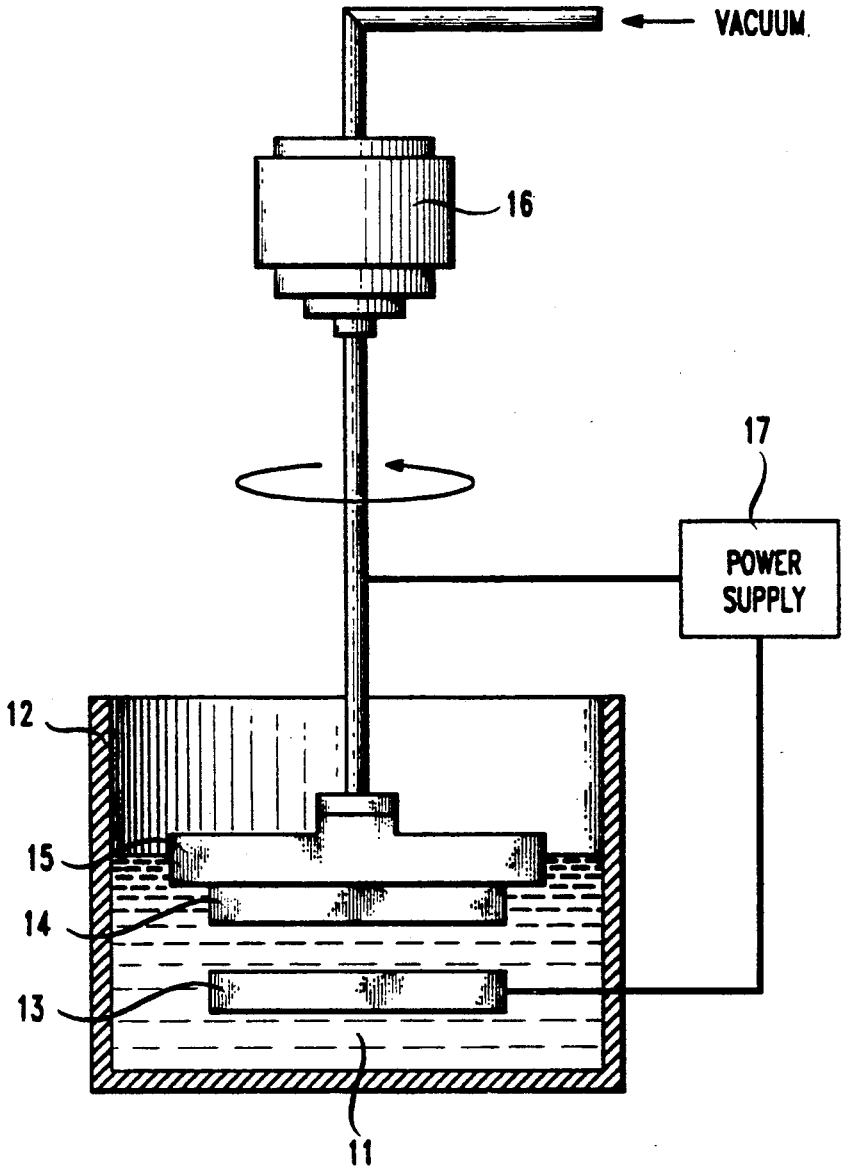

The apparatus shown comprises a liquid suspension 11 in container 12, cathode 13, workpiece 14 and workpiece support 15. The workpiece support is the anode in this cell and consists of a vacuum chuck rotated by drive motor 16. The power supply is shown at 17.

These elements are described now in more detail as exemplary for the practice of the process of the invention.

The solution for the electrophoresis process is a dispersion medium comprising a liquid having physical properties needed to maintain a suspension of particulate material, as well as sufficient resistivity and dielectric constant to support an electric field, and thus impart charge to the particulates to cause their transport in the electric field. Appropriate suspension media for electrophoretic processes are well known in the art, and include, for example, water, and a variety of organic liquids such as ethylene glycol, various alcohols, and mixtures of these liquids. For high purity electrophoretic deposition, a preferred result of this invention, it is important that the suspension medium be free of certain ionic material, e.g. sodium that would contaminate the anodic coating. The preferred result of this invention, it is deionized water. The particulate matter used in forming the coating in the principal embodiment of this invention is diamond, either synthetic or natural. Alternatively the predeposit or nucleating layer may comprise cubic boron nitride or beta silicon carbide, in which case appropriate particles of these materials make up the suspension. In the case of a diamond predeposit, a particle size of 0.1 to 2.0 microns is recommended, although any size or shape particle that is susceptible to electrophoretic deposition can be used. Small particles will remain in suspension due to Brownian forces, although agitation can be used to augment the natural forces. In the apparatus of the FIGURE, the anode is rotated both to agitate the solution and obtain a uniform flow of the dispersion medium over the workpiece. Alternatively the solution itself can be agitated or stirred while the workpiece is maintained stationary. Particles of the order of 0.5 micron or less have been deposited using the apparatus described. Small particles give higher nucleation density deposits and are especially useful if the layer is to be pattern with fine features. Patterning the predeposit will be described below.

The workpiece shown in the FIGURE is a wafer, e.g. a semiconductor wafer. However, a wide variety of materials can be coated with diamond for a variety of industrial applications. Cutting edges of refractory materials like tungsten carbide, silicon nitride or silicon carbide can be enhanced with diamond coatings. In these cases a conducting interlayer such as nickel may be required prior to electrophoretic deposition of diamond. Of the semiconductor materials, silicon is most widely used, and diamond layers are known to be advantageous for silicon device heat sinks. Gallium arsenide and other III–V semiconductors, and II–VI semiconductors, can also be treated by the process of the invention. Semiconductor material of either conductivity type can be coated, although most of the experiments performed to date have been conducted using p-type material. Ultimately the substrate material is limited by its ability to withstand the 900°–1100° C. temperatures required for subsequent CVD overgrowth of diamond on the electrophoretically nucleated layer.

A wide range of electrical conditions will cause the suspended particles to electrophoretically deposit on the workpiece. A recommended range is 1 to 40 volts per centimeter. The thickness of the deposited layer is self limiting to approximately less than or equal to one monolayer, i.e. approximately 1000 angstroms.

When using diamond particulates it is preferred that they be prewashed in e.g. a mineral acid, such as hydrochloric, nitric, or perchloric acid. Ultrasonic agitation can be used to advantage in the cleaning step. The acid solution may be centrifuged, washed with deionized water and optionally dried before introducing the clean particulates into the dispersion medium and into the electrophoresis cell. The precleaning step is especially useful if the process is used in semiconductor applications, where low sodium content and high purity are important. The precleaning step just described also appears to enhance the electrophoretic mobility or zeta potential of the particles, i.e. the intrinsic surface charge on the particles. This surface charge is well known to enable electrophoretic transport and deposition. High electrophoretic mobilities are obtained for natural diamond by aqueous washing in 15% HCl and dispersing the precleaned particles in deionized water under ambient conditions and at the resultant pH=5.6. Under normal conditions, the specific conductivity of the dispersion medium is approximately 1 Mega ohm-cm.

As mentioned earlier, the adhesion of diamond layers is frequently a concern for many important industrial applications. The adhesion of a diamond predeposit formed by the process just described is excellent, and can be even further enhanced by annealing. For silicon wafers, an anneal at a temperature of 700° C. or higher for a few minutes or more, is recommended.

We claim:

1. Process for depositing a patterned diamond layer on a silicon substrate comprising the steps of:

forming an oxide layer on the silicon substrate, photolithographically patterning the oxide layer to form regions of exposed silicon, immersing the patterned silicon substrate in a suspension consisting essentially of diamond particulates in pure water, subjecting the patterned silicon substrate to an externally applied electric field for a period of time and with a voltage sufficient to electrophoretically deposit diamond particulates on the exposed regions of the silicon substrate.

2. Process of claim 1 in which the silicon substrate is p-type.

* * * * *